US006760560B2

(12) United States Patent
Nagai et al.

(10) Patent No.: US 6,760,560 B2
(45) Date of Patent: Jul. 6, 2004

(54) DEVELOPING APPARATUS AND IMAGE FORMING APPARATUS EMPLOYING IT

(75) Inventors: Takashi Nagai, Osaka (JP); Hidekazu Tamura, Osaka (JP); Seiji Kikushima, Osaka (JP); Toru Takatsuna, Osaka (JP); Hiroko Higuchi, Osaka (JP); Hiroaki Moriyama, Osaka (JP); Kouzou Teramoto, Osaka (JP); Noriya Okamoto, Osaka (JP)

(73) Assignees: Kyocera Mita Corporation, Osaka (JP); Kyocera Corporation, Kyoto (JP)

( * ) Notice: Subject to any disclaimer, the term of this patent is extended or adjusted under 35 U.S.C. 154(b) by 0 days.

(21) Appl. No.: 10/156,830

(22) Filed: May 30, 2002

(65) Prior Publication Data

US 2003/0031482 A1 Feb. 13, 2003

(30) Foreign Application Priority Data

Jun. 27, 2001 (JP) ..... 2001-194316

(51) Int. Cl.[7] ..... G03G 15/09; G03G 15/08

(52) U.S. Cl. ..... 399/267; 399/252; 399/279; 399/286

(58) Field of Search ..... 399/53, 159, 222, 399/252, 265, 267, 270, 279, 285, 286; 430/105, 111.4, 120

(56) References Cited

U.S. PATENT DOCUMENTS

| | | | | |
|---|---|---|---|---|
| 4,870,461 | A | * | 9/1989 | Watanabe et al. ..... 399/270 |
| 6,178,306 | B1 | * | 1/2001 | Mizoguchi et al. ..... 399/267 X |
| 6,201,942 | B1 | * | 3/2001 | Honda et al. ..... 399/286 |
| 6,295,437 | B1 | * | 9/2001 | Hodoshima et al. .... 399/159 X |
| 6,389,245 | B2 | * | 5/2002 | Shida et al. ..... 399/58 |
| 6,421,516 | B1 | * | 7/2002 | Kinoshita et al. ..... 399/254 |

FOREIGN PATENT DOCUMENTS

| | | | |
|---|---|---|---|
| JP | 09-073229 | * | 3/1997 |

* cited by examiner

*Primary Examiner*—Sandra L. Brase
(74) *Attorney, Agent, or Firm*—Smith, Gambrell & Russell, LLP

(57) ABSTRACT

A developing apparatus has a developer supporting member 41 with a surface roughness $R_Z$ in the range from 3.0 to 5.5 $\mu$m and a one-component developer T with a bulk density in the range from 0.35 to 0.55 g/ml, and an image is developed by forming a layer of the developer T on the developer supporting member 41. This makes it possible to form a thin toner layer stably despite changes in ambient conditions, and to prevent low image density and fogging. The absolute value of the amount of electric charge with which the developer T is charged is preferably in the range from 3.0 to 10.0 $\mu$C/g. The developer supporting member 41 is made preferably of stainless steel.

9 Claims, 1 Drawing Sheet

DEVELOPING APPARATUS AND IMAGE FORMING APPARATUS EMPLOYING IT

BACKGROUND OF THE INVENTION

1. Field of the Invention

The present invention relates to a developing apparatus and an image forming apparatus, and more particularly to a developing apparatus and an image forming apparatus using a one-component developer.

2. Description of the Prior Art

Methods for dry development of an electrostatic latent image are roughly grouped into two-component development methods using a toner and a carrier and one-component development methods using a toner but not a carrier. One-component development methods, which do not require a carrier, help make developing apparatus compact and light-weight, and in addition do not require maintenance such as replacement of a carrier. For these reasons, one-component development methods are used in low-speed, small-size copiers and printers, and have recently been becoming increasingly widely used even in medium- and high-speed copiers and printers.

However, one-component development methods have a drawback of suffering from occasional disturbances in the thin toner layer supported on a supporting member, ascribable to changes in ambient conditions such as temperature and humidity. Moreover, one-component development methods, compared with two-component development methods, tend to charge the toner with a smaller amount of electric charge with less even distribution. This sometimes leads to flaws in the obtained image, such as low image density or increased toner adhesion in a non-image area (hereinafter referred to as fogging).

SUMMARY OF THE INVENTION

An object of the present invention is to provide a developing apparatus and an image forming apparatus that can form a thin toner layer so stably as not to cause flaws in the obtained image despite changes in ambient conditions.

Another object of the present invention is to provide a developing apparatus and an image forming apparatus that can be used in medium- and high-speed copiers and printers.

To achieve the above objects, according to one aspect of the present invention, a developing apparatus is provided with a developer supporting member with a surface roughness $R_Z$ in the range from 3.0 to 5.5 $\mu$m and a one-component developer with a bulk density in the range from 0.35 to 0.55 g/ml, and an image is developed by forming a layer of the developer on the developer supporting member. With a developing apparatus structured in this way, it is possible to form a thin toner layer stably on the developer supporting member despite changes in ambient conditions, and to prevent lower image density and increased fogging. In the present specification, surface roughness $R_Z$ is given as the average of roughness measured at ten spots as defined in JIS (Japanese Industrial Standards) B0601. On the other hand, bulk density denotes the weight per unit volume (g/ml) of the toner when a predetermined container is filled with it under no load, and thus indicates the flowability of the toner.

According to another aspect of the present invention, an image forming apparatus is provided with an image supporting member, charging means for charging the surface of the image supporting member with electric charge, exposing means for irradiating the charged surface of the image supporting member with light to form an electrostatic latent image, developing means for feeding a developer to the electrostatic latent image to develop an image, and transferring means for transferring the developer on the image supporting member developed by the developing means to a transferred-image member. Used as the developing means here is a developing apparatus as described above. With an image forming apparatus structured in this way, just as described above, it is possible to form a thin toner layer stably on the developer supporting member despite changes in ambient conditions, and to prevent lower image density and increased fogging.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Figure 1:
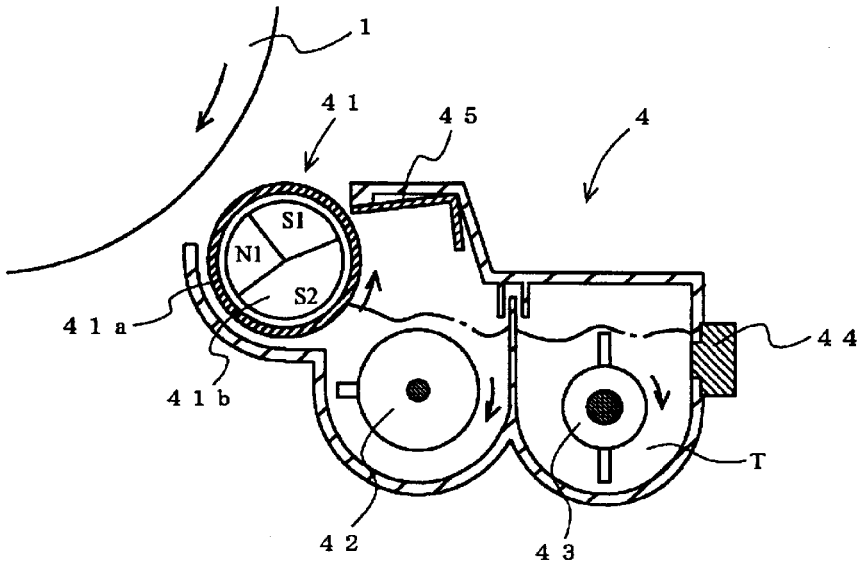
FIG. 1 is a sectional view showing an example of a developing apparatus according to the invention.

As a result of an intensive study made in search of a developing apparatus and an image forming apparatus that use a one-component developer but nevertheless can form a thin toner layer stably despite changes in ambient conditions and thus do not cause flaws in the obtained image, the inventors of the present invention have found out that the thin toner layer formed on a developer supporting member is greatly influenced by the surface roughness of the developer supporting member and the flowability of the toner, which finding has led to the present invention. That is, the main features of the present invention are that the surface roughness of the developer supporting member is restricted within a prescribed range, and that in addition the bulk density of the toner, which indicates the flowability of the toner, is restricted within a prescribed range.

First of all, in a developing apparatus according to the invention, it is essential that the developer supporting member have a surface roughness $R_Z$ in the range from 3.0 to 5.5 $\mu$m. If the developer supporting member has a surface roughness smaller than 3.0 $\mu$m, it cannot transport the developer effectively and cannot produce a uniform thin layer. On the other hand, if the developer supporting member has a surface roughness greater than 5.5 $\mu$m, the particles of the developer are caught in depressions in the surface of the developer supporting member and fuse to it. A further preferred range of the surface roughness $R_Z$ is from 3.5 to 4.5 $\mu$m.

The surface roughness of the developer supporting member can be controlled to within the aforementioned range, for example, by treating it by blasting. The desired surface roughness is obtained by appropriately selecting or adjusting the type of the blasted material, the pressure of compressed air, the duration of blasting, the distance from the blast nozzle to the developer supporting member, and other conditions. Examples of the blasted material include sand, glass beads, and steel balls.

The developer supporting member is made of, advisably, a non-magnetic material such as stainless steel or aluminum alloy, of which stainless steel is preferred for its high wear resistance and other properties.

In a developing apparatus according to the invention, it is also essential that the toner have a bulk density in the range from 0.35 to 0.55 g/ml. If the toner has a bulk density lower than 0.35 g/ml, in other words, if its flowability is too low, it is charged with a smaller amount of electric charge and thus less of it is supported on the developer supporting member, resulting in lower image density and increased fogging. On the other hand, if the toner has a bulk density higher than 0.55 g/ml, in other words, if its flowability is too high, the thin toner layer on the developer supporting member becomes non-uniform. A further preferred range of the bulk density of the toner is from 0.45 to 0.50 g/ml.

The bulk density of the toner correlates with its flowability, and therefore the bulk density of the toner can be controlled to within the aforementioned range by controlling its flowability. The desired bulk density can be obtained, for example, by appropriately selecting or adjusting the type and amount of the surface treatment agent with which the toner particles are coated.

The toner used in a developing apparatus according to the invention can be manufactured by a process that itself is conventionally known, such as crushing-and-classifying, melt granulation, spray granulation, or suspension/emulsification polymerization. Among these, from the viewpoint of manufacturing equipment and productivity, crushing-and-classifying is preferred. Crushing-and-classifying is performed in the following manner. First, a toner composition containing a binder resin and a colorant, with a magnetic powder, a charge control agent, a mold release agent, and the like added thereto as required, is premixed in a Henschel mixer or a V-blender, and is then melt and kneaded in a melting-kneading machine such as a twin-screw extruder. The toner composition thus melted and kneaded is cooled, is then subjected to coarse/fine crushing, and is then, as required, classified to obtain toner particles having the desired particle size distribution. As required, the surfaces of the toner particles are treated with a surface treatment agent to finish the toner. The toner used in the invention may be magnetic or non-magnetic; however, from the viewpoint of the stability of the toner layer on the developer supporting member and the density of the obtained image, a magnetic toner is preferred.

To obtain high quality images, the toner has a volume center particle diameter preferably in the range from 5.0 to 12.0 $\mu$m, and is charged with an amount of electric charge preferably in the range from 3.0 to 10.0 $\mu$C/g on an absolute value basis.

The binder resin may be of any type, examples including styrene-acrylic resin and polyester resin. Needless to say, as required, these types of resin may be used in combination with another type of resin.

Examples of the monomers that are used as the base of the styrene-acrylic resin include: derivatives of styrene such as styrene, α-methylstyrene, p-methylstyrene, p-t-butylstyrene, p-chlorstyrene, and hydroxystyrene; and esters of (meth) acrylic acid such as methacrylic acid, methyl (meth)acrylate, ethyl (meth)acrylate, propyl (meth)acrylate, butyl (meth) acrylate, glycidyl (meth)acrylate, methoxyethyl (meth) acrylate, propoxyethyl (meth)acrylate, methoxydiethylene glycol (meth)acrylate, ethoxydiethylene glycol (meth) acrylate, benzil (meth)acrylate, cyclohexyl (meth)acrylate, tetrahydrofurfuryl (meth)acrylate, (meth)acrylonitrile, (meth)acrylamide, N-methylol (meth)acrylamide, ethylene glycol di(meth)acrylate, 1,3-butylene glycol di(meth) acrylate, 1,4-butanediol di(meth)acrylate, and trimethylol ethane tri(meth)acrylate.

A mixture of some of these monomers is made into the binder resin used in the invention by polymerizing the mixture by an appropriate process such as solution polymerization, block polymerization, emulsion polymerization, or suspension polymerization. In the polymerization process here, any conventionally known polymerization initiator can be used, examples including: acetyl peroxide, decanoyl peroxide, lauroyl peroxide, benzoyl peroxide, azobisisobutyronitrile, 2,2'-azobis-2,4-dimethylvaleronitrile, and 2,2'-azobis-4-methoxy-2,4-dimethylvaleronitrile. Preferably 0.1 to 15% by weight of one of these polymerization initiators is added to the total weight of the monomers.

The polyester resin is produced mainly through condensation polymerization of a polycarboxylic acid and a polyhydric alcohol. Examples of the polycarboxylic acid include: aromatic polycarboxylic acids such as phthalic acid, isophthalic acid, terephthalic acid, succinic acid, 1,2,4-benzenetricarboxylic acid, 2,5,7-naphthalenetricarboxylic acid, 1,2,4-naphthalenetricarboxylic acid, and pyromellitic acid; aliphatic dicarboxylic acids such as maleic acid, fumaric acid, succinic acid, adipic acid, sebacic acid, malonic acid, azelaic acid, mesaconic acid, citraconic acid, and glutaconic acid; alicyclic dicarboxylic acids such as cyclohexane dicarboxylic acid and cyclohexenedicarboxylic acid; and anhydrides and lower alkyl esters of these carboxylic acids. These are used singly or as a mixture of two or more of them.

Here, the content of components with three or more carboxyl or hydroxy groups depends on the degree of cross-linking, and therefore the desired degree of cross-linking can be achieved by controlling the amount of such components added. In general, a preferred content of components with three or more carboxyl or hydroxy groups is 15 mol % or lower.

On the other hand, examples of the polyhydric alcohol used in the polyester resin include: alkylene glycols such as ethylene glycol, 1,2-propylene glycol, 1,3-propylene glycol, 1,4-butanediol, 1,4-butenediol, neopentyl glycol, 1,5-pentane glycol, and 1,6-hexane glycol; alkylene ether glycols such as diethylene glycol, triethylene glycol, dipropylene glycol, polyethylene glycol, polypropylene glycol, and polytetramethylene glycol; alicyclic polyhydric alcohols such as 1,4-cyclohexame dimethanol and hydrogenated bisphenol A; and bisphenols such as bisphenol A, bisphenol F, and bisphenol S, and alkylene oxides of such bisphenols. These are used singly or as a mixture of two or more of them.

As required, monocarboxylic acids and monohydric alcohols may be used for the purpose of adjusting the molecular weight and controlling the reaction. Examples of monocarboxylic acids include benzoic acid, p-hydroxybenzoic acid, toluenecarboxylic acid, salicylic acid, acetic acid, propionic acid, and stearic acid. Examples of monohydric alcohols include benzil alcohol, toluene-4-methanol, and cyclohexane methanol.

It is preferable that the binder resin used have a glass transition point in the range from 45 to 90° C. With a glass transition point below 45° C., the binder resin may gather together inside a toner cartridge or a developer unit. On the other hand, with a glass transition point over 90° C., the toner may not fuse satisfactorily onto a transfer material such as paper.

Examples of the colorant are as follows. Examples of colorants for a black toner include: carbon black, acetylene black, lamp black, and aniline black. Examples of colorants for a yellow toner include: azo pigments, such as C. I.

pigment yellow 1, C. I. pigment yellow 5, C. I. pigment yellow 12, C. I. pigment yellow 15, C. I. pigment yellow 17, C. I. pigment yellow 180, C. I. pigment yellow 74, C. I. pigment yellow 4, C. I. pigment yellow 81, C. I. pigment yellow 97, and C. I. pigment yellow 93; inorganic pigments, such as yellow iron oxide and ocher; nitro dyes, such as C. I. acid yellow 1; and oil-soluble dyes, such as C. I. solvent yellow 2, C. I. solvent yellow 6, C. I. solvent yellow 14, C. I. solvent yellow 15, C. I. solvent yellow 19, and C. I. solvent yellow 21. Examples of colorants for a magenta toner include: C. I. pigment red 49, C. I. pigment red 57, C. I. pigment red 81, C. I. pigment red 122, C. I. pigment red 184, C. I. pigment red 238, C. I. solvent red 19, C. I. solvent red 49, C. I. solvent red 52, C. I. basic red 10, and C. I. disperse red 15. Examples of colorants for a cyan toner include: C. I. pigment blue 15, C. I. pigment blue 16, C. I. solvent blue 55, C. I. solvent blue 70, C. I. direct blue 25, and C. I. direct blue 86. These colorants may be used singly or as a mixture of two or more of them. Preferably 0.1 to 20 parts by weight, and particularly preferably 1 to 15 parts by weight, of the colorant(s) in total is added to 100 parts by weight of the binder resin.

In general, a magnetic toner containing a magnetic powder has a black color originating from the magnetic powder, and thus does not require a colorant when used as a black toner. However, its color may be reinforced by dispersing carbon black, such as acetylene black, lamp black, or aniline black, in the toner particles. In that case, preferably 0.1 to 10 parts by weight of the colorant is added to 100 parts by weight of the binder resin.

When a magnetic one-component toner is used, examples of the magnetic powder added to the binder resin include: triiron tetroxide ($Fe_3O_4$), iron sesquioxide ($\gamma$-$Fe_2O_3$), iron zinc oxide ($ZnFe_3O_4$), iron yttrium oxide ($Y_3Fe_5O_{12}$), iron cadmium oxide ($CdFe_2O_4$), iron gadolinium oxide ($Gd_3Fe_5O_{12}$), iron copper oxide ($CuFe_2O_4$), iron lead oxide ($PbFe_{12}O_{19}$), iron nickel oxide ($NiFe_2O_4$), iron neodyum oxide $NdFeO_3$), iron barium oxide ($BaFe_{12}O_{19}$), iron magnesium oxide ($MgFe_2O_4$), iron manganese oxide ($MnFe_2O_4$), iron lanthanum oxide ($LaFeO_3$), iron powder (Fe), cobalt powder (Co), and nickel powder (Ni). Among these, a particularly preferred magnetic powder is fine particle triiron tetroxide (magnetite). Suitable magnetite has regular-octahedral particles with particle diameters from 0.05 to 1.0 $\mu$m. Magnetite particles may be subjected to surface treatment using a silane coupler or a titanium-based coupler. Preferably 50 to 30 parts by weight, and particularly preferably 70 to 150 parts by weight, of the magnetic powder is added to 100 parts by weight of the binder resin.

The charge control agent may be of any conventionally known type, examples including: as charge control agents that tend to be positively charged, nigrosine dyes, nigrosine dyes denatured with a fatty acid, nigrosine dyes denatured with a fatty acid containing a carboxyl group, quaternary ammonium salts, amine-based compounds, and organic metallic compounds; and, as charge control agents that tend to be negatively charged, metallic complexes of a hydroxycarboxylic acid, metallic complexes of an azo compound, metal complex dyes, and salicylic acid derivatives.

The mold release agent may be one of various types of wax or low-molecular-weight olefin resin. Examples of wax include: esters of a fatty acid with a polyhydric alcohol; esters of a fatty acid with a higher alcohol; amides of an alkylenebis fatty acid; and natural waxes. Examples of low-molecular-weight olefin resin include: polypropylene, polyethylene, and propylene-ethylene copolymer with a number-average molecular weight in the range from 1,000 to 10,000, in particular in the range from 2,000 to 6,000. Among these, polypropylene is particularly suitable.

The surface treatment agent may be any substance that improves the charge controllability and bulk density (flowability) of the toner, examples including: inorganic fine particle powder such as silica, alumina, titanium oxide, zinc oxide, magnesium oxide, and calcium carbonate; organic fine particle powder such as polymethyl methacrylate; and metallic salts of a fatty acid such as zinc stearate. These are used singly or as a mixture of two or more of them. Preferably 0.1 to 2.0% by weight of the surface treatment agent is added to the toner. The surface treatment agent is mixed with the toner, for example, in a Henschel mixer, V-blender, tumbler mixer, or hybridizer.

FIG. 1 is a sectional view showing an example of a developing apparatus according to the invention. This developing apparatus 4 is provided with a developing sleeve (developer supporting member) 41 composed of a sleeve 41*a* and a magnet 41*b* housed inside and fixed to it, a first agitating/transporting member 42 having a spiral shape, and a second agitating/transporting member 43 having a spiral shape. To the upper right of the developing sleeve 41, a blade 45 for restricting the amount of toner transported to a developing section and charging the toner with electric charge by friction is arranged at a predetermined distance from the developing sleeve 41. On a side wall to the right of the second agitating/transporting member 43, a toner sensor 44 for detecting the amount of toner is arranged.

When the toner sensor 44 detects a shortage of the toner inside the developing apparatus 4, a fresh supply of toner T is fed from a toner hopper (not shown) to the developing apparatus 4. The supplied toner T is first transported, while being agitated, in the direction from the front side to the back side of the figure by the second agitating/transporting member 43, and is then, at the back-side end, fed from the second agitating/transporting member 43 to the first agitating/transporting member 42. The toner T is then transported, while being agitated, in the direction from the back side to the front side of the figure by the first agitating/transporting member 42, and meanwhile an appropriate amount of it is fed to the developing sleeve 41. The toner T fed to the developing sleeve 41 is, as the developing sleeve 41 rotates counter-clockwise, fed to a position facing a photoconductor 1 (developing section). Meanwhile, the amount of toner fed to the developing section is controlled by the blade 45, and simultaneously a thin layer of the toner is formed; moreover, the toner T is charged with electric charge by friction. Here, the developing sleeve 41 is so structured that the magnet 41*b* housed inside it is stationary and the cylindrical sleeve 41*a* is rotatable; however, it may be so structured that the magnet 41*b* is rotatable and the sleeve 41*a* is stationary, or that both the magnet 41*b* and the sleeve 41*a* are rotatable (in the same direction or in the opposite directions).

An electrostatic latent image on the photoconductor (image supporting member) may be developed by charged area development, whereby the electrostatic latent image is developed with the toner charged with a polarity opposite to the unexposed portion on the photoconductor, or by reversal development, whereby the electrostatic latent image is developed with the toner charged with the same polarity as the unexposed portion on the photoconductor. The development may be achieved by contact development, in which the thin toner layer makes contact with the photoconductor, or by toner projection development (jumping development), in which they do not make contact with each other. To obtain high-quality images, reversal development and toner projection development are each preferred among their peers, and their combined use is further preferred. In that case, the photoconductor is charged with the same polarity as the toner, and exposure removes the electric charge of the portion corresponding to the latent image. Moreover, in the developing section, an alternating voltage obtained by superimposing an alternating-current voltage on a direct-current voltage is applied, as a developing bias voltage, between the developing sleeve and the photoconductor. As a result, the toner on the developing sleeve jumps to and attaches to the discharged electrostatic latent image on the photoconductor, making the electrostatic latent image visible as a toner image.

The photoconductor used here may be made of any conventionally known material, examples including an amorphous silicon photoconductor, organic photoconductor, Se-based photoconductor, ZnO photoconductor, and CdS-based photoconductor. Among these, an amorphous silicon photoconductor is preferred for its high durability. The photoconductor may have any conventionally known shape, examples including a drum-like, sheet-lie, belt-like, and web-like shape. Among these, a drum-like shape is preferred.

Figure 2:
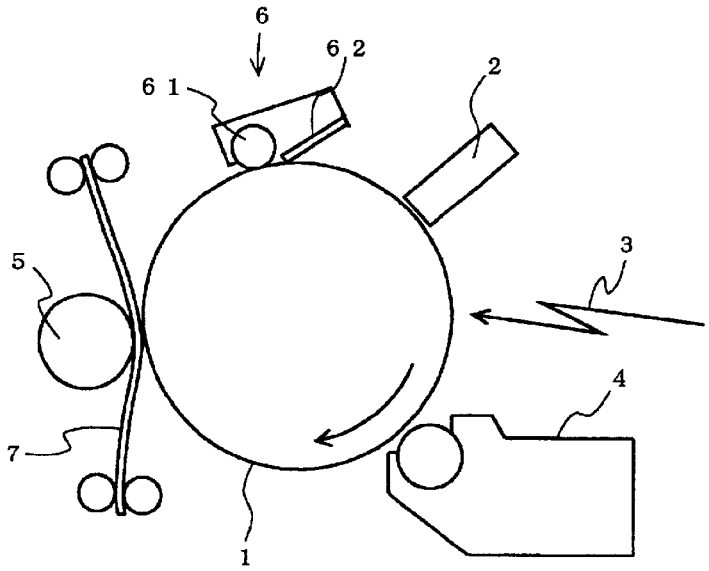
FIG. 2 is a sectional view showing an example of an image forming apparatus according to the invention.

Next, an image forming apparatus according to the invention will be described. FIG. 2 is a sectional view showing an example of an image forming apparatus according to the invention. The surface of a photoconductor 1 is charged uniformly with positive electric charge by a charging means 2. Next, an electrostatic latent image (exposed portion) is formed on the surface of the photoconductor 1 by an exposing means 3. Then, by the use of the developing apparatus 4 described above, the electrostatic latent image is sprinkled with toner from the thin toner layer formed on the developing sleeve having the magnet housed inside it, so that the electrostatic latent image is turned into a visible image. Then, the toner image on the photoconductor 1 is transferred to a transferred-image member 7 by a transferring means 5. Thereafter, the toner image on the transferred-image member 7 is subjected to heat and pressure by an unillustrated fixing means so as to be fused and fixed to the transferred-image member 7. On the other hand, the toner left on the photoconductor 1, i.e. the toner that has not been transferred, is roughly removed by a cleaning brush 61 and then completely removed by a cleaning blade 62 in a cleaning means 6.

EXAMPLES

Preparation of Toners

Toner ingredients, specifically 100 parts by weight of styrene-acrylic resin serving as a binder resin, 7 parts by weight of a charge control agent, and 80 parts by weight of a magnetic powder, were put and mixed in a Henschel mixer, were then melt-kneaded in a twin-screw extruder, were then cooled in a drum flaker, and were then coarsely crushed on a hammer mill. The resultant granules were then finely crushed on a mechanical mill, and were then classified with a pneumatic classifier to obtain toner particles with a predetermined volume average particle diameter. These toner particles were blended with 0.6% by weight of silica (with a particle diameter of 0.012 $\mu$m) and 1.4% by weight of titanium oxide (with a particle diameter of 0.25 $\mu$m), and were mixed through intense agitation in a Henschel mixer to obtain a magnetic one-component toner "a" that tends to be charged positively.

In similar manners, with different amounts of charge control agent and silica added as shown in Table 1, magnetic one-component toners "b" to "k" were prepared.

The bulk density of each of the toners thus prepared and the amount of electric charge with which it was charged were measured in the manners described below. The results also are shown in Table 1.

Measurement of the Bulk Density of the Toners

With each toner, 30*g* of it was put in a container, from which the toner was quietly poured into a funnel with a sieve. With a 30 ml collecting container placed under the funnel, the toner on the sieve was stirred with a brush for 90 seconds to make the toner disperse and fall. Then, the weight of the toner collected in the collecting container was measured, and the bulk density of the toner was calculated according to the following formula:

$$\text{Bulk Density } (g/ml) = \text{Toner Weight}/\text{Collecting Container Volume}$$

Measurement of the Electric Charge of the Toners

With each toner, the amount of electric charge with which the toner newly fed to the developing sleeve immediately after consumption in a solid black portion was charged was measured. Specifically, immediately after consumption in a solid black portion, a suction nozzle is put to the developing sleeve, and, by the use of a vacuum pump, the toner on the developing sleeve was collected in a Faraday cage. Then, the electric charge of the toner collected there was measured with an electrometer.

Evaluation of the Obtained Images

With five types of developing sleeve with surface roughnesses of 2.5 to 6.0 $\mu$m, and with the magnetic one-component toners prepared as described above, measurements were made of the density of and fogging in the images obtained initially at normal temperature and normal humidity on a high-speed printer structured as shown in FIG. 2 and capable of printing 50 sheets per minute. Moreover, the condition of the thin toner layer on the developing sleeve at low temperature and at low humidity was inspected. The measurement and evaluation were performed in the manners described below. The development was by non-contact development using as the photoconductor an amorphous silicon photoconductor, using a developing bias voltage obtained by superimposing a direct-current of 160 V on an alternating-current voltage with a frequency of 2.5 kHz and a peak-to-peak voltage of 1.9 kV, with the surface voltage of the latent image on the photoconductive drum set at 10 V in bright portions and 240 V in dark portions, and with the gap between the developing sleeve and the photosensitive drum set at 320 $\mu$m. The results are shown in Table 2.

Measurement of the Density of and Fogging in the Obtained Images

The density of the obtained images was measured, in a solid black portion and a non-image portion thereof, by the use of a reflection density meter (the model TC-6D manufactured by Tokyo Denshoku Co., Ltd., Japan), and was evaluated as follows: the initial image density is evaluated as "GOOD" if 1.3 or higher and as "NG" otherwise; the initial fogging is evaluated as "GOOD" if 0.005 or lower and as "NG" otherwise.

Unevenness of the Thin Layer

The condition of the surface of the developing sleeve before starting bulk printing at low temperature and low humidity (10° C., 20%) was visually inspected, and was evaluated as follows: the surface condition was evaluated as "GOOD" if no toner adhesion was observed and as "NG" if toner adhesion was observed.

As will be clear from Table 2, any of the image forming apparatus of Practical Examples 1 to 7 structured according to the invention offered a satisfactory initial image density, and produced tolerable fogging. Moreover, with those image forming apparatus, no unevenness was observed in the thin layer. On the other hand, the image forming apparatus of Comparative Example 1, in which the developing sleeve had a surface roughness as small as 2.5 $\mu$m, produced in tolerable fogging, and the image forming apparatus of Comparative Example 2, in which the developing sleeve had a surface roughness as large as 6.0 $\mu$m, offered too low an image density and suffered from unevenness in the thin layer. The image forming apparatus of Comparative Example 3, in which the toner had a bulk density as low as 0.32 g/ml offered too low an image density, and the image forming apparatus of Comparative Example 4, in which the toner had a bulk density as high as 0.69 g/ml offered too low an image density and suffered from unevenness in the thin layer.

TABLE 1

| Toner No. | Silica (wt %) | Charge Control Agent (wt %) | Bulk Density (g/ml) | Electric Charge ($\mu$C/g) |
|---|---|---|---|---|
| a | 0.6 | 7 | 0.511 | +6.8 |
| b | 0.4 | 7 | 0.372 | +3.3 |
| c | 0.6 | 9 | 0.541 | +9.7 |
| d | 0.6 | 9 | 0.541 | +7.1 |
| e | 0.4 | 7 | 0.372 | +4.8 |
| f | 0.6 | 9 | 0.541 | +8.2 |
| g | 0.4 | 7 | 0.372 | +4.5 |
| h | 0.6 | 5 | 0.510 | +2.5 |
| I | 0.6 | 9 | 0.515 | +7.0 |
| j | 0.4 | 7 | 0.321 | +4.0 |
| k | 0.8 | 7 | 0.689 | +8.9 |

TABLE 2

| | Toner | | | Developing Sleeve | | | |
|---|---|---|---|---|---|---|---|
| | No. | Bulk Density | Electric Charge | Surface Roughness | Thin Layer Unevenness | Image Density | Fogging |
| Practical Example 1 | a | 0.511 | +6.8 | 4.0 | GOOD | GOOD | GOOD |
| Practical Example 2 | b | 0.372 | +3.3 | 3.1 | GOOD | GOOD | GOOD |
| Practical Example 3 | c | 0.541 | +9.7 | 5.3 | GOOD | GOOD | GOOD |
| Practical Example 4 | d | 0.541 | +7.1 | 3.1 | GOOD | GOOD | GOOD |
| Practical Example 5 | e | 0.372 | +4.8 | 5.3 | GOOD | GOOD | GOOD |
| Practical Example 6 | f | 0.541 | +8.2 | 4.0 | GOOD | GOOD | GOOD |
| Practical Example 7 | g | 0.372 | +4.5 | 4.0 | GOOD | GOOD | GOOD |
| Comparative Example 1 | h | 0.510 | +2.5 | 2.5 | GOOD | GOOD | NG |
| Comparative Example 2 | I | 0.515 | +7.0 | 6.0 | NG | NG | GOOD |
| Comparative Example 3 | j | 0.321 | +4.0 | 4.0 | GOOD | NG | GOOD |
| Comparative Example 4 | k | 0.689 | +8.9 | 4.0 | NG | GOOD | GOOD |

What is claimed is:

1. A developing apparatus comprising a developer supporting member with a surface roughness $R_z$ in a range from 3.0 to 5.5 $\mu$m and a one-component developer with a bulk density in a range from 0.45 to 0.55 g/ml, wherein an image is developed by forming a layer of the developer on the developer supporting member.

2. A developing apparatus as claimed in claim 1, wherein an absolute value of an amount of electric charge with which the developer is charged is in a range from 3.0 to 10.0 $\mu$C/g.

3. A developing apparatus as claimed in claim 1, wherein the developer supporting member is made of stainless steel.

4. An image forming apparatus comprising an image supporting member, charging means for charging a surface of the image supporting member with electric charge, exposing means for irradiating the charged surface of the image supporting member with light to form an electrostatic latent image, developing means for feeding a developer to the electrostatic latent image to develop an image, and transferring means for transferring the developer on the image supporting member developed by the developing means to a transferred-image member, wherein used as the developing means is a developing apparatus comprising a developer supporting member with a surface roughness $R_z$ in a range from 3.0 to 5.5 $\mu$m and a one-component developer with a bulk density in a range from 0.45 to 0.55 g/ml, the developing apparatus developing an image by forming a layer of the developer on the developer supporting member.

5. An image forming apparatus as claimed, in claim 4, wherein an absolute value of an amount of electric charge with which the developer is charged is in a range from 3.0 to 10.0 $\mu$C/g.

6. An image forming apparatus as claimed in claim 4, wherein the developer supporting member is made of stainless steel.

7. An image forming apparatus as claimed in claim 4, wherein a gap between the image supporting member and the developer supporting member is greater than a thickness of the layer of the developer formed on the developer supporting member, and the image is developed by feeding the developer to the electrostatic latent image while an alternating-current bias voltage is applied between the image supporting member and the developer supporting member.

8. An image forming apparatus as claimed in claim 4, wherein the developing means develops the electrostatic latent image by letting the toner charged with electric charge of a same polarity as an unexposed portion of the image supporting member attach to an exposed portion thereof.

9. An image forming apparatus as claimed in claim 4, wherein the image supporting member is an amorphous silicon photoconductor.

* * * * *